US008056524B2

(12) United States Patent
Todo et al.

(10) Patent No.: US 8,056,524 B2
(45) Date of Patent: Nov. 15, 2011

(54) LASH ADJUSTER

(75) Inventors: Kimihiko Todo, Aichi (JP); Hiroki Fujii, Aichi (JP)

(73) Assignee: Otics Corporation, Aic (JP)

( * ) Notice: Subject to any disclaimer, the term of this patent is extended or adjusted under 35 U.S.C. 154(b) by 291 days.

(21) Appl. No.: 11/896,896

(22) Filed: Sep. 6, 2007

(65) Prior Publication Data

US 2008/0066705 A1 Mar. 20, 2008

(30) Foreign Application Priority Data

Sep. 20, 2006 (JP) ..... 2006-254752

(51) Int. Cl.
*F01L 1/14* (2006.01)

(52) U.S. Cl. ..... 123/90.58; 123/90.52; 123/90.55

(58) Field of Classification Search ..... 123/90.52, 123/90.53, 90.55, 90.56, 90.57, 90.58
See application file for complete search history.

(56) References Cited

U.S. PATENT DOCUMENTS

| | | | | |
|---|---|---|---|---|
| 3,262,434 | A | 7/1966 | Kuchen et al. | |
| 3,267,918 | A | 8/1966 | Ayres | |
| 4,864,982 | A | 9/1989 | Speil | |
| 5,361,733 | A | 11/1994 | Spath et al. | |
| 5,398,648 | A * | 3/1995 | Spath et al. | 123/90.16 |
| 6,006,710 | A * | 12/1999 | Stephan | 123/90.43 |
| 6,598,572 | B2 * | 7/2003 | Cecur et al. | 123/90.55 |

FOREIGN PATENT DOCUMENTS

| | | |
|---|---|---|
| EP | 0 608 925 | 8/1994 |
| EP | 1 267 046 | 12/2002 |
| GB | 751705 | 7/1956 |
| GB | 1017793 | 1/1966 |
| JP | 59-147808 | 8/1984 |
| JP | 61-066811 | 4/1986 |
| JP | 1-163409 | 6/1989 |
| JP | 3-172633 | 7/1991 |
| JP | 5-10257 | 1/1993 |
| JP | 5-318012 | 12/1993 |

OTHER PUBLICATIONS

European Search Report dated Mar. 23, 2009 for European Application No. 07 01 7150.
Japanese Office Action issued Sep. 30, 2010 in connection with corresponding Japanese Patent Application No. 2006-254752, with English translation.
Decision of Japanese Patent Office issued Dec. 13, 2010 in corresponding Japanese Application No. 2006-254752.

* cited by examiner

*Primary Examiner* — Zelalem Eshete

(57) ABSTRACT

A return spring is formed using a compression coil spring that is installed so that its axial direction is an up-down direction. The return spring is provided in a high-pressure chamber, and powers a plunger in an upwards direction. A coil diameter of the return spring varies along the axial direction. When the return spring is in a maximally compressed state, an axial direction dimension (up-down direction dimension) is smaller than a dimension that is a thickness of a spring wire multiplied by the number of coil turns. Hence, an overall height of a lash adjuster A can be reduced in comparison to when a return spring with a constant coil diameter over an entire length is used.

20 Claims, 13 Drawing Sheets

LASH ADJUSTER

CROSS REFERENCE TO RELATED APPLICATION

This application claims priority from Japanese Patent Application No. 2006-254752 filed Sep. 20, 2006. The entire content of this priority application is incorporated herein by reference.

TECHNICAL FIELD

The present invention relates to a hydraulic lash adjuster used in a valve train of an internal combustion engine.

BACKGROUND

One well-known hydraulic lash adjuster is described in Japanese Patent Laid-Open No. 61-066811. This lash adjuster includes a cylinder having a base and fixed to a cylinder head, a plunger fitted in the cylinder so as to be movable up and down, and a return spring that powers the plunger in an upwards direction. An upper end part of the plunger, at an end that protrudes from the cylinder, supports a rocker arm. A low-pressure chamber is provided in the plunger, and a high-pressure chamber is provided in a lower end part of the cylinder. The high-pressure and low-pressure chambers are separated by a base wall of the plunger. Operating oil is supplied to the low-pressure chamber via a through hole provided in a circumferential wall of the cylinder, a through hole provided in a circumferential wall of the plunger, and an oil gallery provided in the cylinder head. A valve hole is provided in the base wall of the plunger, and the operating oil flows into the high-pressure chamber from the low-pressure chamber via the valve hole.

In the above-described lash adjuster, a spherical valve body and a return spring are provided in the high-pressure chamber. The return spring powers the valve body in the upwards direction so that the valve body closes the valve hole. Together the valve body and the return spring form a non-return valve for opening and closing the valve hole.

When the rocker arm is pressing down the plunger, the valve hole is closed by the valve body, and the high-pressure chamber is in sealed state. Thus, oil pressure in the operating oil that fills the high-pressure chamber supports the plunger, preventing downwards movement.

When the rocker arm is not pressing down the plunger, the valve body moves downwards, opening the valve hole, and so operating oil flows into the high-pressure chamber from the low-pressure chamber. Thus, the volume of the high-pressure chamber increases, and the plunger is allowed to rise.

In the above-described conventional lash adjuster, the return spring provided in the high-pressure chamber is a compression coil spring. A coil diameter of the compression coil spring is constant along an entire length (from an upper end to a lower end). Hence, a return spring axial direction (the up-down direction) dimension when the plunger is down and the return spring is in a maximally compressed state corresponds to a dimension that is a number windings multiplied by a thickness of the spring wire.

It should be noted that a high-pressure chamber height must accommodate at least the up-down dimension of the return spring when in a maximally compressed state and a plunger stroke length in the up-down direction. Therefore, when the up-down direction dimension of the return spring is large, the height of the high-pressure chamber increases, and an overall height of the lash adjuster has to increase.

The present invention was conceived after considering the above-described problem, and has an object of reducing the height of the lash adjuster.

SUMMARY

A first invention is a lash adjuster including: a cylinder having a base; a plunger that is movable up and down in contact with an inner circumferential peripheral surface of the cylinder; a low-pressure chamber provided in the plunger; a high-pressure chamber provided in a lower end part of the cylinder; a return spring provided in the high-pressure chamber; and a non-return valve that opens and closes a valve hole provided in a base wall of the plunger, wherein the low-pressure chamber holds operating oil, the high-pressure chamber is filled with the operating oil, the high-pressure chamber and the low-pressure chamber are separated by the base wall of the plunger, the return spring is a compression coil spring provided so that its axial direction aligns with the up-down direction, the return spring is provided in the high-pressure chamber, the return spring powers the plunger in an upwards direction, and the return spring has a coil diameter that varies along the axial direction.

According to the first invention, the coil diameter varies along the axial direction, and so the axial direction (up-down direction) dimension of the return spring when in a maximally compressed state is smaller than a dimension that is the spring wire thickness multiplied by the number of windings. The height of the high-pressure chamber, and as a result, the height of the entire lash adjuster can therefore be reduced.

A second invention is a lash adjuster in which the coil diameter of the return spring becomes progressively smaller from a top section to a bottom section.

According to the second invention, the coil diameter of the return spring becomes progressively smaller from a top section to a bottom section, and so contact interference between the non-return valve and the return spring can be avoided.

A third invention is a lash adjuster characterized in which the non-return valve is constructed from a valve member provided in the high-pressure chamber, the valve member is a single body that includes a retainer part fixed to the plunger base wall and an elastic bending piece that opens and closes the valve hole by bending in the up-down direction.

According to the third invention, the valve member is formed from a single body that includes a retainer part and an elastic bending piece, and so a number of parts that make up a valve member can be reduced (in other words, the conventional construction of the non-return valve in which a valve spring powers the spherical valve body towards the valve hole is no longer necessary).

The fourth invention is a lash adjuster in which the retainer part and the elastic bending piece are formed in substantially a same plane, and are substantial plate-like.

According to the fourth invention, a thickness of the valve member can be reduced. Hence, the height of the lash adjuster can be reduced.

The fifth invention is a lash adjuster in which a seal part with a curved surface is formed on the elastic bending piece, and the seal part is line-contactable with an edge of the valve hole.

According to the fifth invention, the seal part formed on the elastic bending piece is line-contactable with an edge of the valve hole, and so the sealing of the valve hole is favorable.

The sixth invention is a lash adjuster in which a recessed portion is provided in a lower surface of the base wall of the plunger, and the retainer part is forcibly inserted into the recessed portion.

According to the sixth invention, a dedicated part is not required as a means to fix the retainer part to the base wall, and so the number of parts can be reduced.

DETAILED DESCRIPTION OF THE PREFERRED EMBODIMENTS

First Embodiment

The following describes a first embodiment of the present invention with reference to FIGS. 1 to 8.

Figure 1:
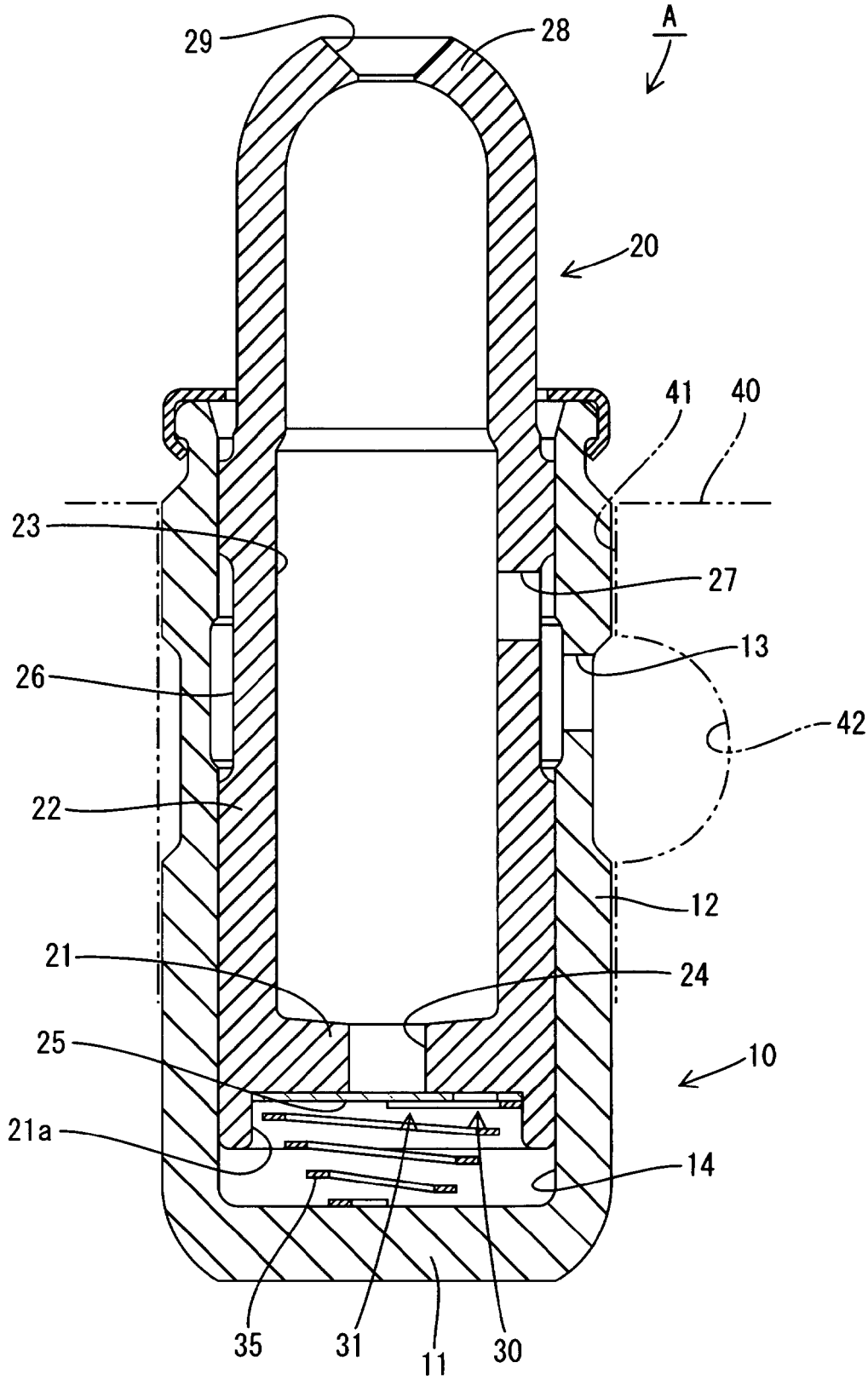
FIG. 1 is cross-sectional diagram of a lash adjuster of a first embodiment.

As shown in FIG. 1, a hydraulic lash adjuster A includes a cylinder 10, a plunger 20, and a non-return valve 30.

The cylinder 10 is a cylinder having a base, and includes a disk-shaped base wall part 11, and a pipe-form circumferential wall part 12 that rises from a circumferential edge of the base wall part 11.

The cylinder 10 is fixed into an attachment hole 41 provided in an upper surface of a cylinder head 40.

An external through hole 13 is provided piercing the circumferential wall part 12 of the cylinder 10 in an internal-external direction. The external through hole 13 communicates with an operating oil supply way 42 provided in the cylinder head 40.

The plunger 20 is a cylinder having a base, and includes a disk-shaped base wall part 21, and a pipe-form circumferential wall part 22 that rises from a circumferential edge of the base wall part 21.

A low-pressure chamber 23 is provided in the plunger 20.

A vertically pierced circular valve hole 24 is provided at a center of the base wall part 21 of the plunger 20.

On a lower surface (a surface facing a high-pressure chamber 14, which is described later) of the base wall part 21, a horizontal (i.e. perpendicular to a movement direction of the plunger 20) seat surface 25 is provided around an edge of the valve hole 24 (see FIG. 2).

Also, a recessed portion 21*a* with an internal diameter larger than the valve hole 24 and a same center as the valve hole 24 is formed in the lower surface of the base wall part 21.

A small diameter section 26, which has a smaller diameter than other sections, is formed in the circumferential wall 22 of the plunger 20. At the small diameter section 26, an internal through hole 27 pierces the circumferential wall 22 in an internal-external direction.

Operating oil in the supply way 42 is supplied to the low-pressure chamber 23 by way of the external through hole 13, the small diameter part 26, and the internal through hole 27 in the order described.

A substantially hemispherical (dome-form) supporting part 28 is formed at an upper end part of the plunger 20. A rocker arm (not shown in the drawings) contacts an external surface of the supporting part 28 from above. The rocker arm is arranged to oscillate with the supporting point 28 as a fulcrum. A circular air hole 29 vertically pierces a central region of an uppermost part of the supporting part 28.

The plunger 20 is fitted into the cylinder 10. The plunger 20 is capable of movement in the up-down direction (an axial direction for the cylinder 10 and the plunger 20) while maintaining contact with an inner circumferential surface of the cylinder 10.

A high-pressure chamber 14 is provided in an internal lower end part of the cylinder 10. The low-pressure chamber 23 and the high-pressure chamber 14 are separated by the base wall part 21 of the plunger 20.

A non-return valve 30 for opening and closing the valve hole 24 is provided in the high-pressure chamber 14. The non-return valve 30 is constructed using a valve member 31.

Figure 5:
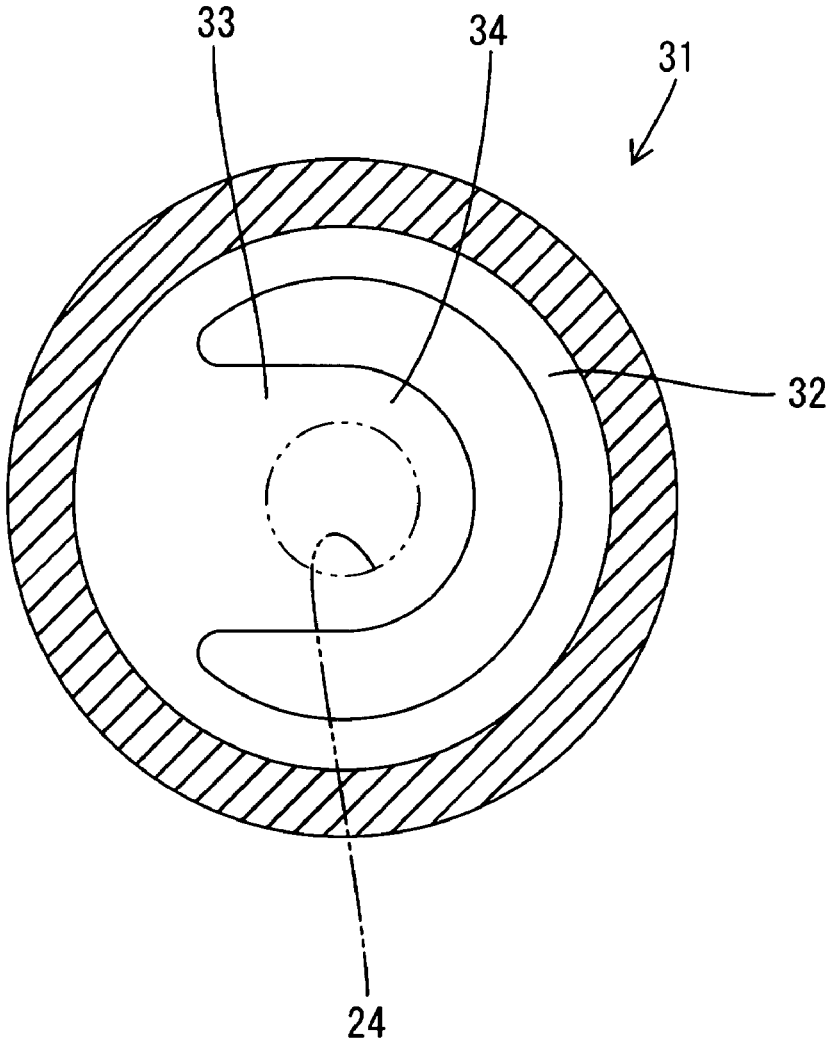
FIG. 5 shows a cross-section through X-X with a return spring omitted.
Figure 6:
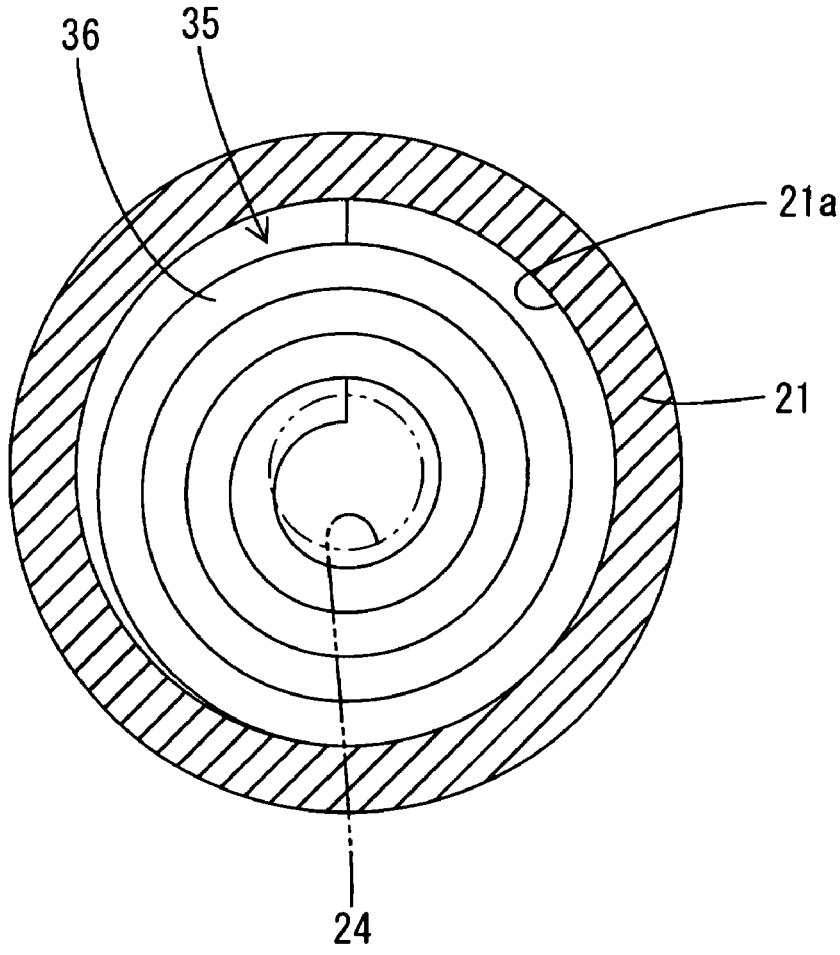
FIG. 6 shows a cross-section through X-X with valve member omitted.
Figure 7:
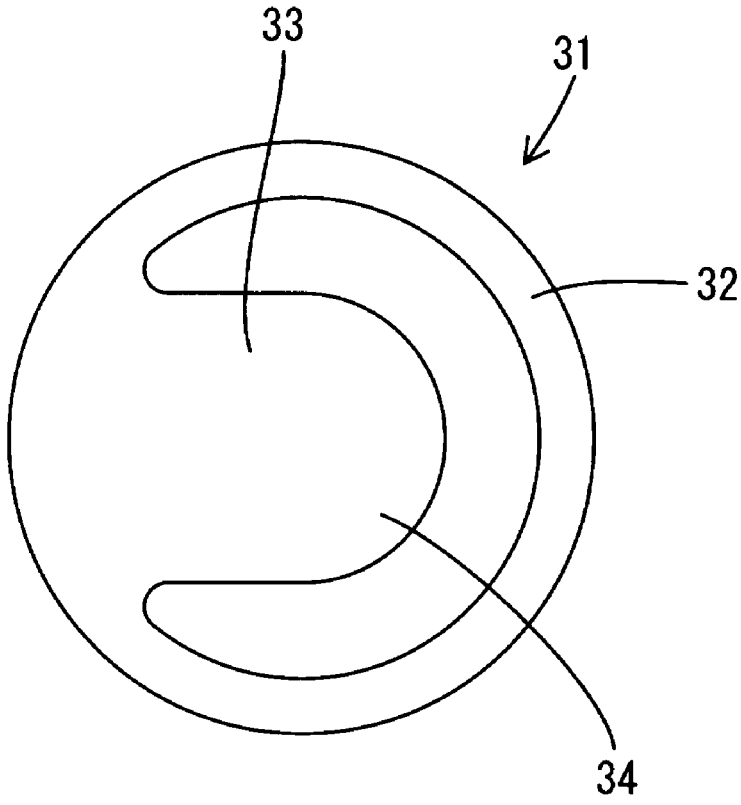
FIG. 7 is a plan view of a valve member.
Figure 8:
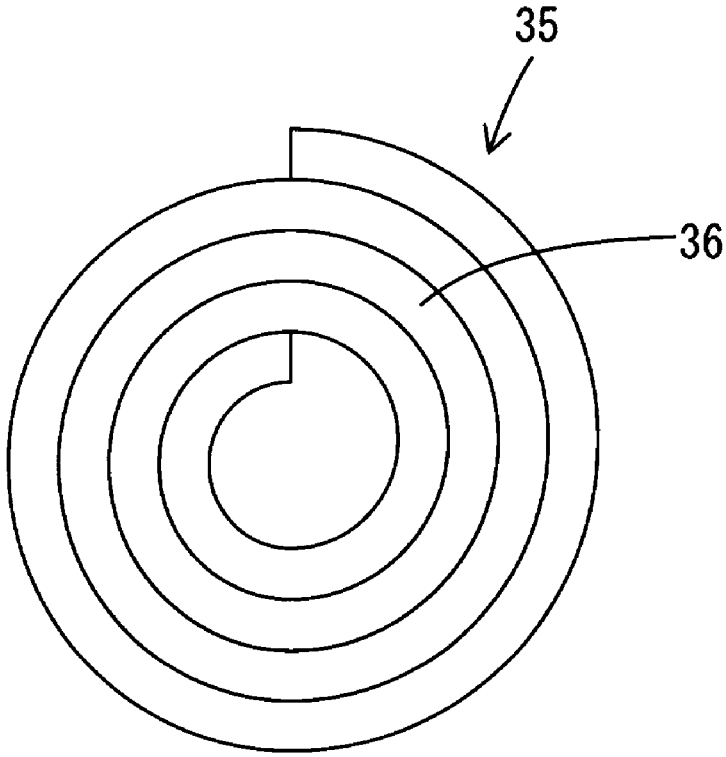
FIG. 8 is a plan view of the return spring.

As shown in FIG. 5, the valve member 31 is a plate-form metal member from which a predetermined section has been removed. The valve member 31 is a single body that includes a ring-form retainer part 32 and a substantially elliptical elastic bending piece 33. The retainer part 32 and the elastic bending piece 33 are formed to lie substantially in a same plane.

A base end part (one end part) of the elastic bending piece 33 connects to the inner circumferential edge of the retainer part 32. A leading end part (the other end part) of the elastic bending piece 33 is substantially semi-circular, and an upper surface of the leading end part forms a seal surface 34. The elastic bending piece 33 is capable of deforming elastically in the up-down direction with the base end part as a fulcrum.

Figure 2:
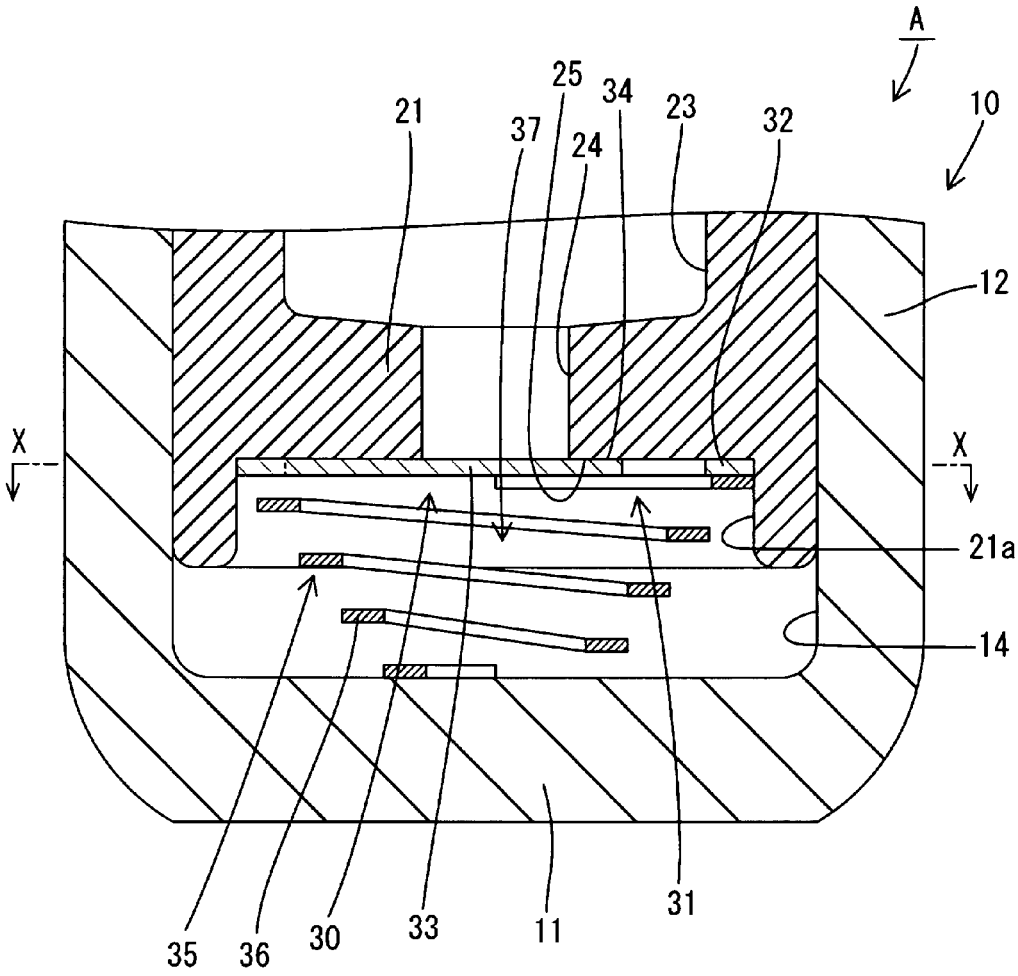
FIG. 2 is an enlarged partial cross-sectional diagram showing a non-return valve in a closed state.

As shown in FIG. 2, the retainer part 32 is forcibly inserted in the recessed portion 21*a* of the plunger 20. This fixes the valve member 31 in the base wall part 21 of the plunger 20.

When the valve member 31 has been fixed in place, an upper surface of the retainer part 32 and the upper surface of the elastic bending piece 33 (the seal surface 34) are in surface contact with the lower surface of the base wall part 21 (a seat surface 25). Moreover, a lower surface side of the valve hole 24 is closed by the leading end part of the elastic bending piece 33.

Figure 3:
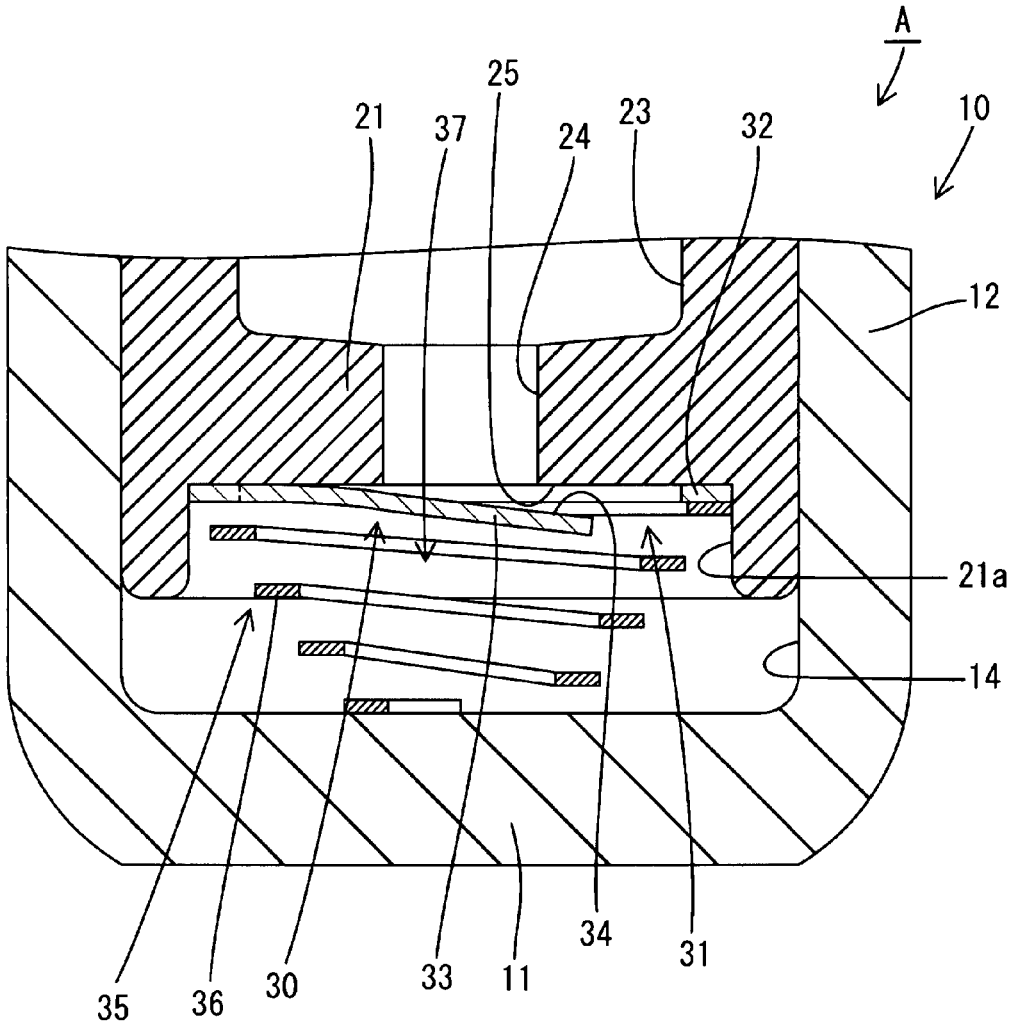
FIG. 3 is an enlarged partial cross-sectional diagram showing the non-return valve in an open state.

As shown in FIGS. 2 and 3, a return spring 35 constructed from a compression coil spring is provided in the high-pressure chamber 14. The return spring 35 is installed so as to have a same axis as the valve hole 24. The return spring 35 is formed using band-form spring wire 36. In cross-section, the spring wire 36 is a rectangle that is long in the horizontal direction. In plan view, the spring wire 36 forms a spiral.

A coil diameter in the return spring 35 is largest at an upper end part, and becomes progressively smaller in a downwards direction. In other words the return spring 35 is inverted-cone-shaped.

Thus, at an uppermost end, the coil diameter of the return spring 35 is largest and is substantially the same as an inner diameter of the retainer part 32 in the valve member 31.

The return spring 35 is elastically deformable in the up-down direction. The return spring 35 is formed so that, when in a state of maximum compression, the spring wire 36 that makes up the return spring 35 does not interfere with itself. This means that, when in the state of maximum compression, the total thickness of the return spring 35 is substantially the same as an up-down direction plate thickness of the spring wire 36.

The return spring 35 is attached in an elastically compressed state between a lower surface of the retainer part 32 of the valve member 31 and a lower surface of the high-pressure chamber 14. Hence, the plunger 20 is always powered upwards by an elastic returning force stored in the return spring 35.

Figure 4:
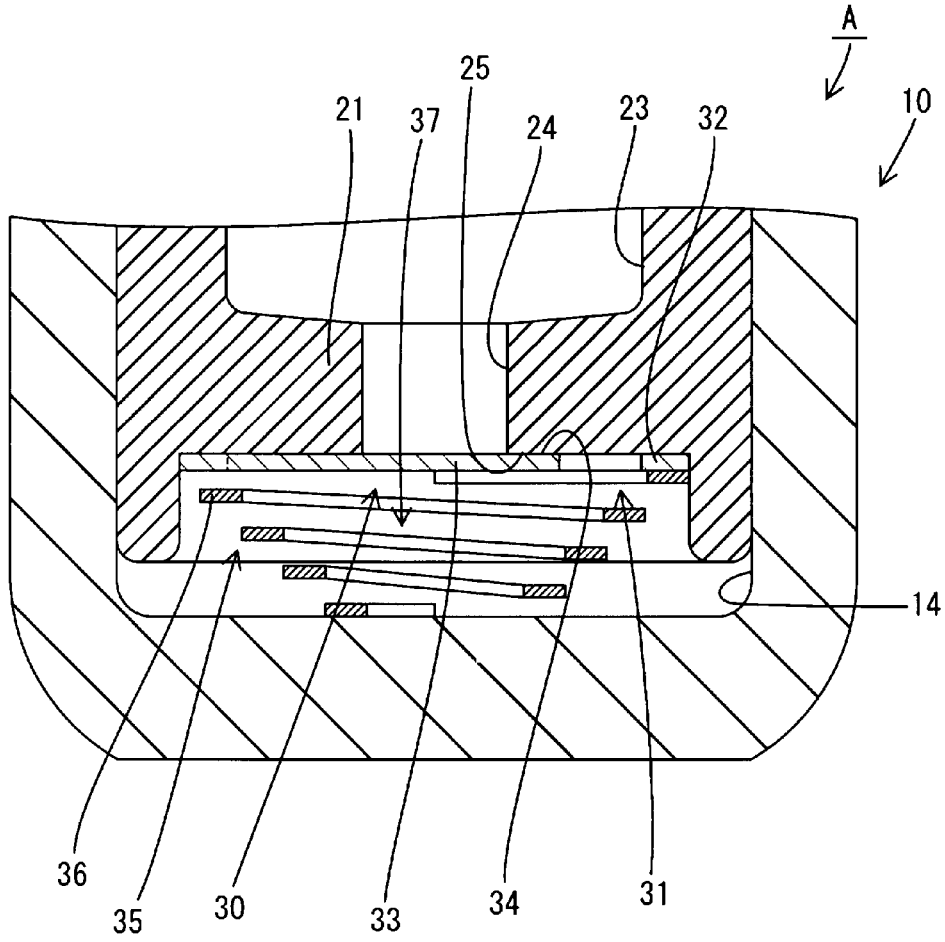
FIG. 4 is an enlarged partial cross-sectional diagram showing the non-return valve in a closed state and the plunger in a pushed-down state.

As shown in FIG. 4, when the plunger 20 is maximally compressed within a normal-use range for a lash adjuster A (i.e. the plunger 20 is in a fully pushed-down state), a an inverted-cone-shaped space 37 formed by the spring wire 36 is maintained below the elastic bending piece 33. Thus, even when the elastic bending piece 33 is elastically deformed downwards, interference with the spring wire 36 is prevented.

The following describes operations of the lash adjuster A of the present embodiment.

When a pressing force from a rocker arm side is working in a downward direction on the plunger 20, the elastic bending piece 33 is in contact with the seat surface 25, and the valve hole 24 is closed. Since the high-pressure chamber 14 is then in a closed state, downwards movement of the plunger 20 is prevented by the operating oil that fills the high-pressure chamber 14 (see FIG. 2).

Conversely, when the plunger 20 has risen, and a volume of the high-pressure chamber 14 has increased, the bending piece 33 elastically deforms so as to move downwards relative to the plunger 20. Since a gap then opens between the elastic bending piece 33 and the seat surface 25 (see FIG. 3), the operating oil flows from the low-pressure chamber 23 to the high-pressure chamber 14, and a state of the high-pressure chamber 14 being full of the operating oil is maintained.

When the rise of the plunger 20 stops, the elastic returning force generated in the elastic bending piece 33 causes the elastic bending piece 33 to return upwards and make contact with the seat surface 25. Since the valve hole 24 is then closed by the elastic bending piece 33, the high-pressure chamber 14 is in a closed state and full of the operating oil.

Since the coil diameter of the return spring 35 varies along the axial direction, an axial direction dimension (up-down direction dimension) of the return spring 35 when in the maximally compressed state is less than a dimension that is the thickness of the spring wire 36 multiplied by the number of coil turns. Hence, an overall height of the lash adjuster A can be reduced in comparison to a conventional return spring with a constant diameter of the coil diameter along an entire length.

The coil diameter of the return spring 35 reduces progressively in a downwards direction from an uppermost end. Hence, when the elastic banding piece 33 that opens and closes the valve hole 24 has changed an up-down position in the high-pressure chamber 14, elastic bending piece 33 is prevented from interfering with the return spring 35.

The substantially plate-form valve member 31 functions both as a valve body for opening and closing the valve hole 24, and as a valve spring for powering the valve body in a valve-closing direction. This eliminates the need for a spherical valve body and a valve spring to power the valve body from below. As a result, it becomes possible to reduce the height of the high-pressure chamber 14.

The elastic bending piece 33 that forms the valve member 31 functions both as a valve body for opening and closing the valve hole 24, and as a valve spring for powering the valve body towards the valve hole 24. Hence, this construction has an advantage of using fewer parts than a construction in which separate parts are used for the valve body and the valve spring.

The retainer part 32 of the valve member 31 is forcibly inserted into the recessed portion 21*a* of the base wall part 21. Hence, a dedicated part for fixing the valve member 31 to the base wall part 21 is unnecessary, and the advantage of a construction with fewer parts can be obtained.

Since the retainer part 32 and the elastic bending piece 33 are formed in substantially the same plane, and have a substantial plate-like form, it is possible to reduce a thickness of the valve member 31 and the thus the height of the lash adjuster A.

Second Embodiment

A second embodiment of the present invention is described with reference to FIGS. 9 and 10.

Figure 9:
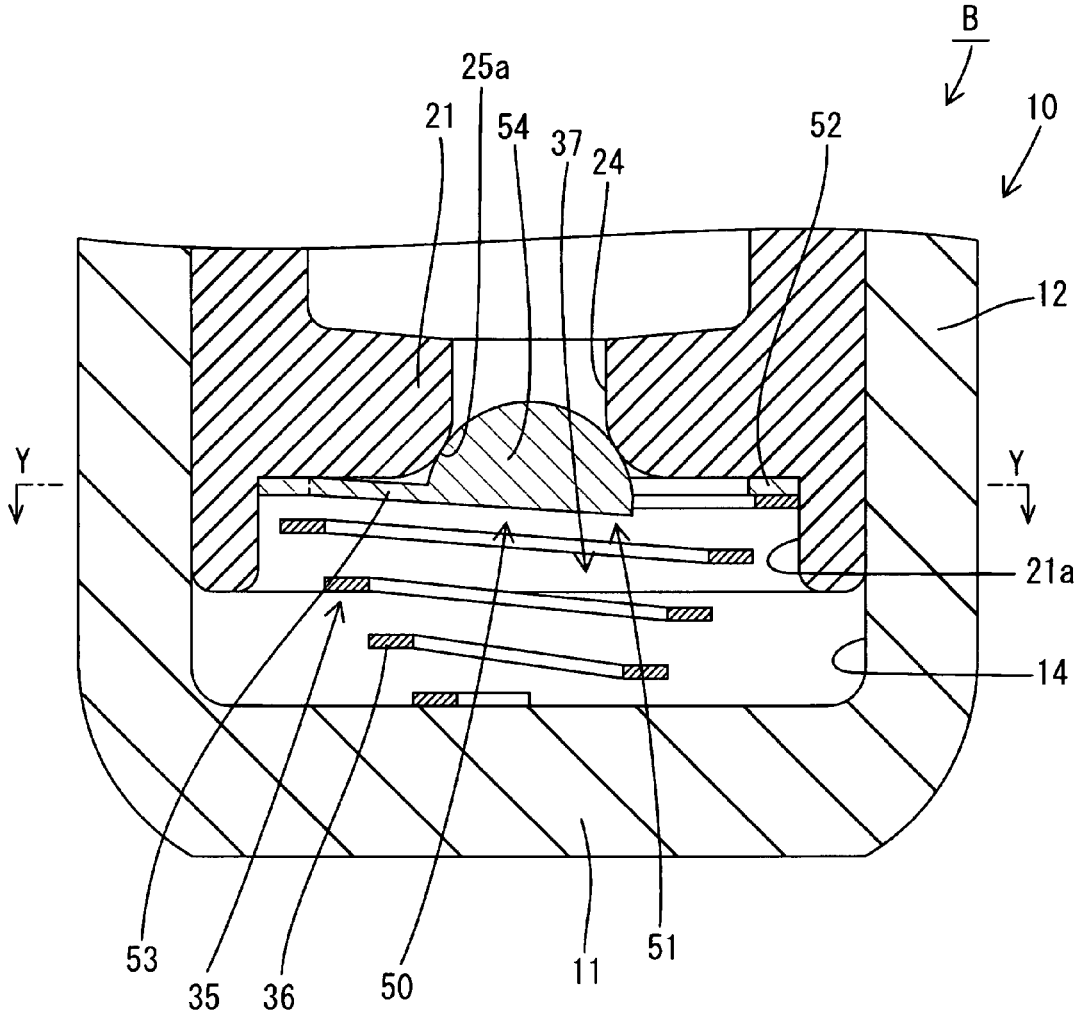
FIG. 9 is an enlarged partial cross-sectional diagram of a lash adjuster of a second embodiment.
Figure 10:
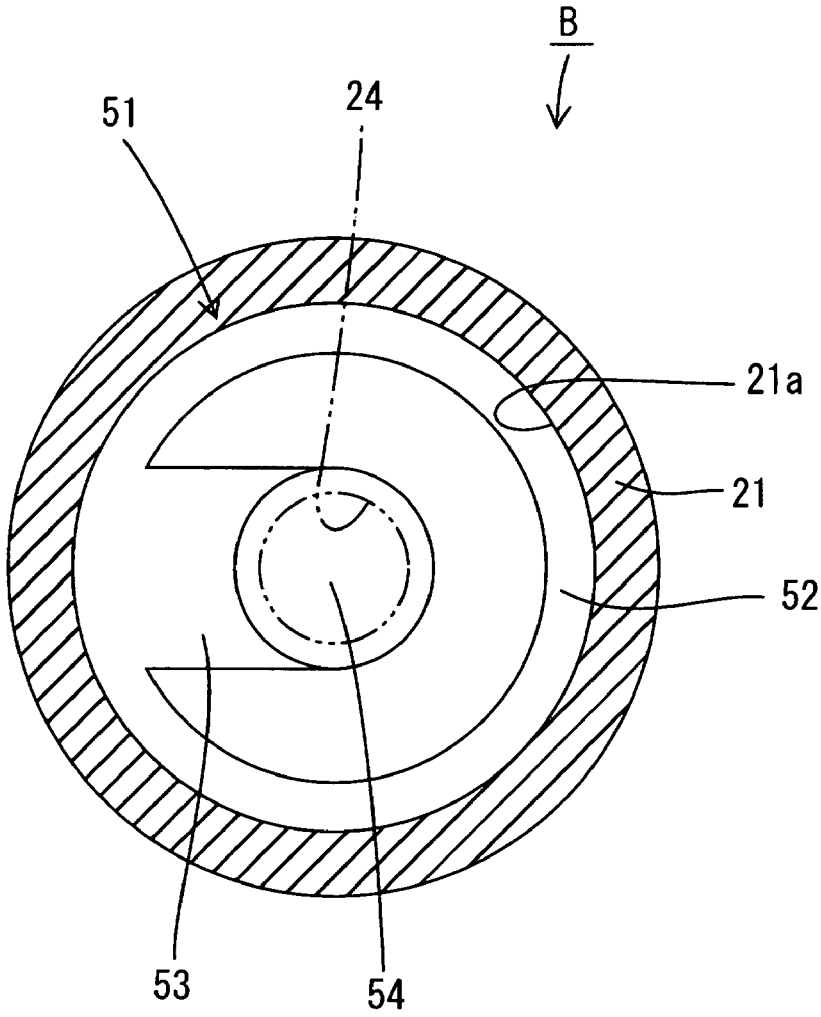
FIG. 10 is a cross-section through Y-Y of FIG. 9.

As shown in FIGS. 9 and 10, in the lash adjuster B of the second embodiment, the valve member 50 and the seat surface 25*a* differ from corresponding parts in the first embodiment. In the following, parts that are substantially the same as those of the first embodiment are labeled with the same symbols, and a description of these parts is omitted.

The vertically pierced circular valve hole 24 is provided at a center of the base wall part 21 of the plunger 20. An arc-form seat surface 25*a* is formed at a hole edge on a lower side (a high-pressure chamber 14 side) of the valve hole 24. The seat surface 25*a* has a diameter that increases progressively as a distance to the high-pressure chamber 14 side reduces, so as to have a downwardly widening profile.

A valve member 51 that forms a non-return valve 50, like the valve member 31 of the first embodiment, is made up of a retainer part 52 and an elastic bending piece 53.

A curved-surface (hemispherical) seal part 54 is formed on an upper surface of a free end of the elastic bending piece 53. A largest external diameter of the seal part 54 is larger than a smallest internal diameter of the valve hole 24.

When the non-return valve 30 is closing the valve hole 24, an external surface of the curved-surface seal part 54 makes line contact around a circle having substantially a same center as the valve hole 24.

In the lash adjuster B of the second embodiment, the elastic bending piece 53 and the hole edge (the seat surface 25*a*) of the valve hole 24 are in line contact, and thus sealing of the valve hole 24 is favorable in comparison to when surface contact is used.

Third Embodiment

Figure 11:
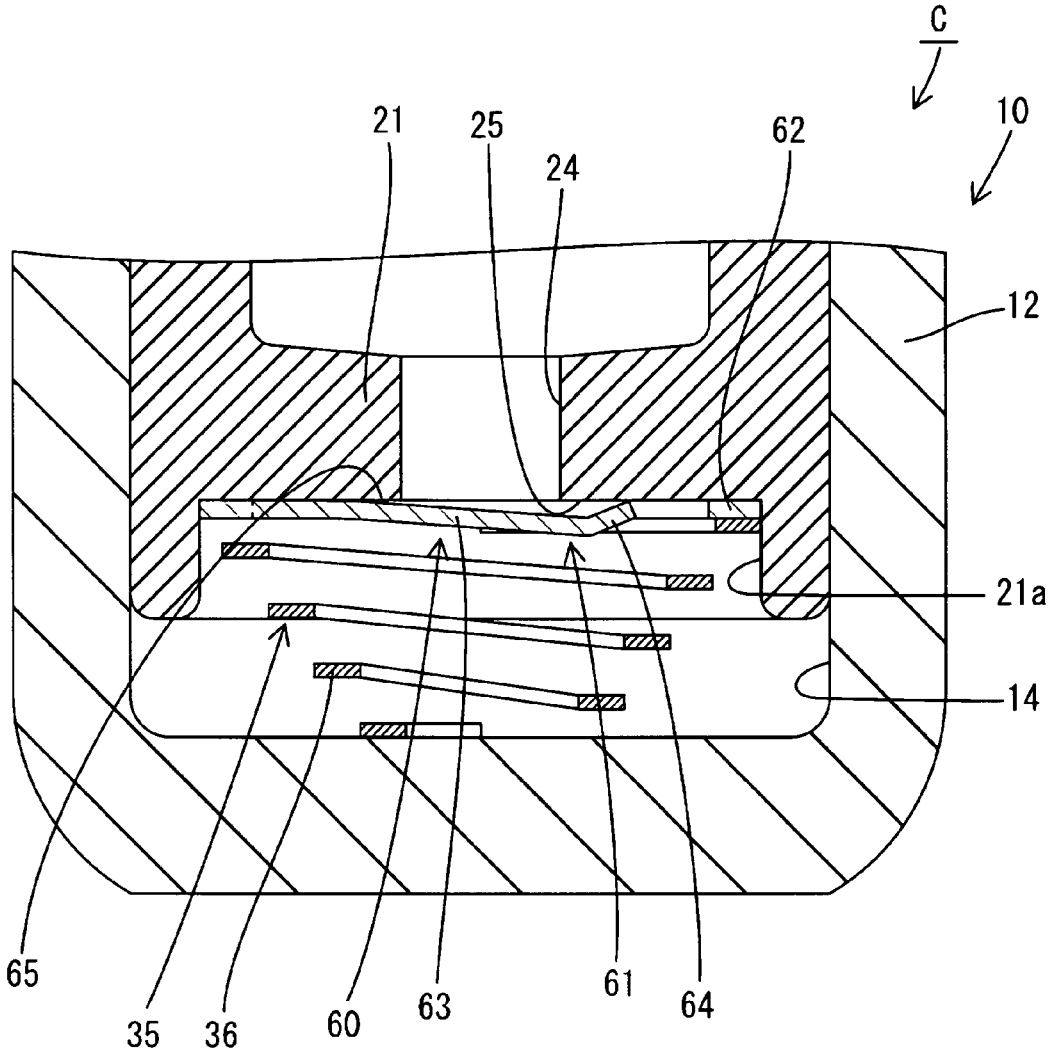
FIG. 11 is an enlarged partial cross-sectional diagram showing the non-return valve of a third embodiment in a closed state.
Figure 12:
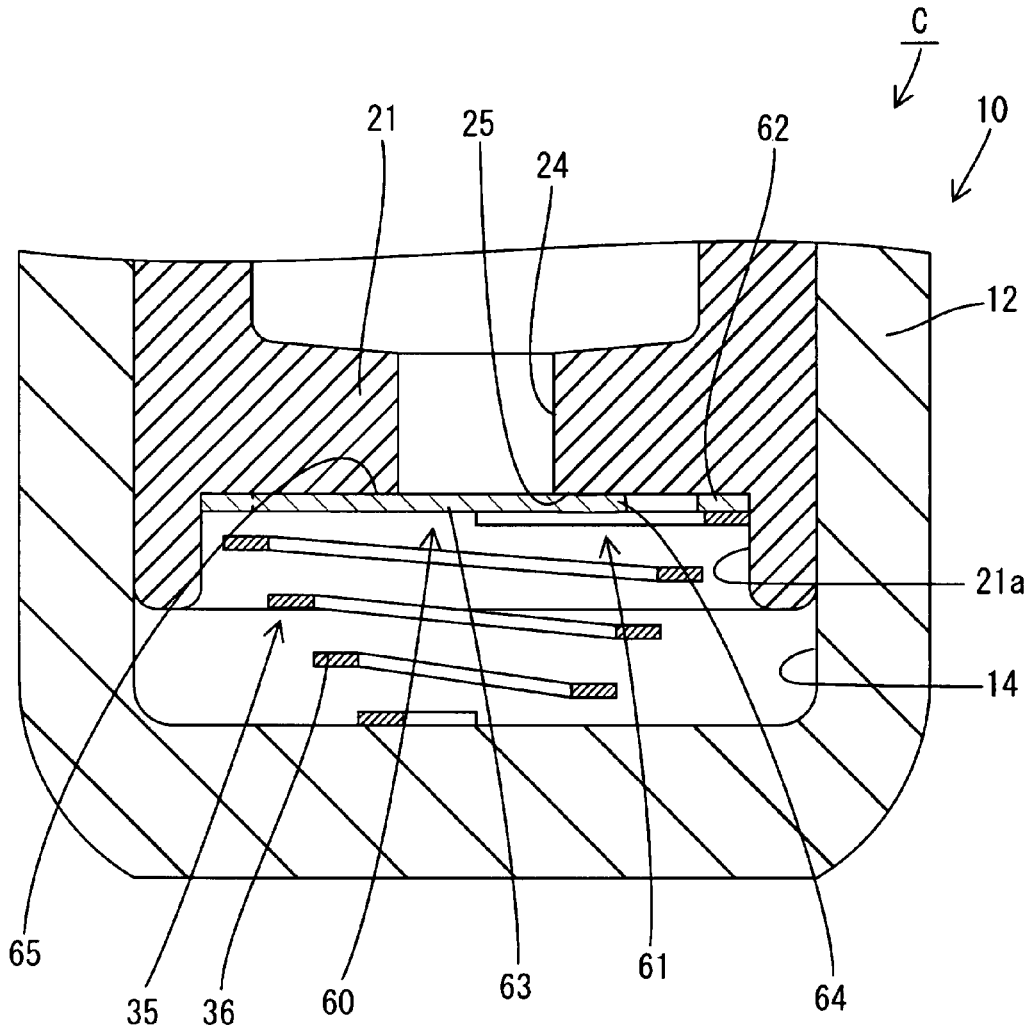
FIG. 12 is an enlarged partial cross-sectional diagram showing the non-return valve of the third embodiment in an open state.
Figure 13:
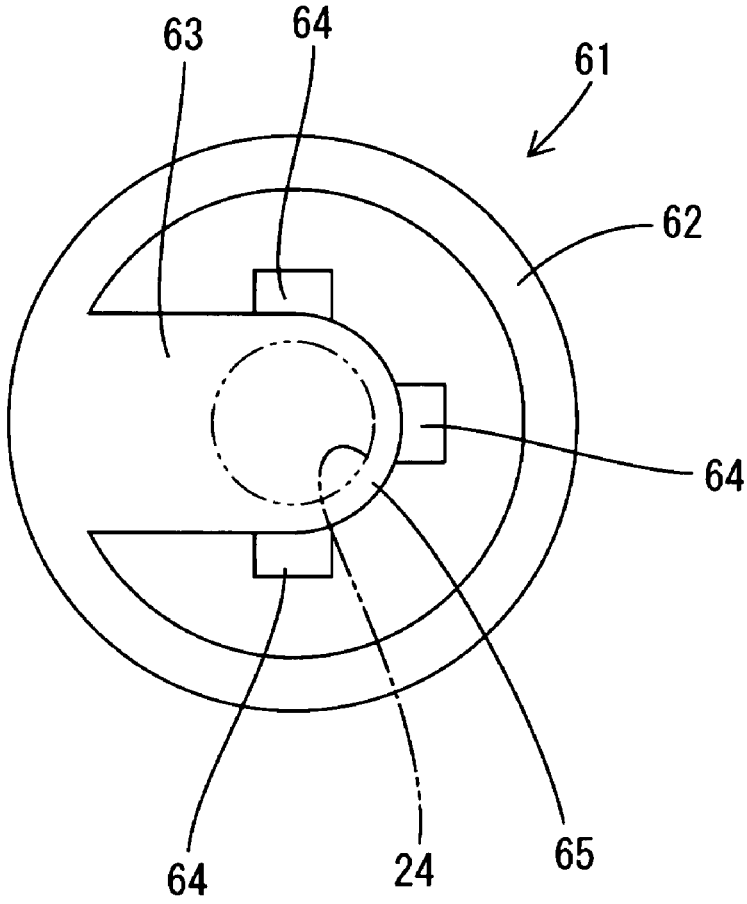
FIG. 13 is a plan view of the valve member.

The following describes a third embodiment of the present invention with reference to FIGS. 11 to 13.

As shown in FIGS. 11 to 13, in a lash adjuster C of a third embodiment, a valve member 61 that forms a non-return valve 60 differs from a corresponding part in the first embodiment, but other parts are substantially the same as corresponding parts in the first embodiment. Thus, in the following, parts that are substantially the same as those of the first embodiment are labeled with the same symbols, and a description of these parts is omitted.

The valve member 61 that forms the non-return valve 60, like the valve member 31 of the first embodiment, is made up of a retainer part 62 and an elastic bending piece 63.

On the elastic bending piece 63, a plurality (three in the present embodiment) of spring pieces 64 is provided so as to protrude in a diagonal upwards direction from an external circumferential edge part of a free end of the elastic bending piece 63 towards an exterior. The spring pieces 64 are capable of bending elastically. The spring pieces 64 are provided at a constant interval in a circumferential direction (at an interval of 90° in the present embodiment).

As shown in FIG. 12, when a pressing force is being strongly applied from the rocker-arm side downwards on the plunger 20, the spring pieces 64 elastically deform, and make surface contacts with the seat surface 25. At this point, the elastic bending piece 63 and the spring pieces 64 are in a substantially same plane, and a seal surface 65 of the bending piece 63 is in surface contact with the seat surface 25. As a result, the valve hole 24 is completely closed by the non-return valve 60, and the flow of operating oil between the low-pressure chamber 23 and the high-pressure chamber 14 is blocked.

As shown in FIG. 11, when a pressing force is being weakly applied from the rocker-arm side downwards on the plunger 20, the spring pieces 64 hardly elastically deform at all, and so the leading ends (free ends) of the spring pieces 64 are in line contact or point contact with the seat surface 25. At this point, a small gap corresponding to a height of the spring pieces 64 is secured between an upper surface (the seal surface 25) of the elastic bending piece 63 and the seat surface 25. This secures a flow of a small amount of operating oil between the low-pressure chamber 23 and the high-pressure chamber 14.

When the plunger 20 moves upwards, the elastic bending piece 63 elastically deforms downwards by a large amount, and so the spring parts 64 separate from the seat surface 25.

Other Embodiments

The present invention is not limited to the embodiments that are described above with reference to the drawings. Examples of the type described below are also included within the technical scope of the present invention.

(1) A spherical valve body and a valve spring that is formed from a compression coil spring and powers the valve body from below may be used in place of the valve member.

(2) Spring wire having a circular cross-section may be used to form the return spring. When spring wire with a circular cross-section is used, the coil diameter may be set so that the spring wire in the coils makes partial contact with itself when the return spring is maximally compressed.

(3) The return spring is not limited to being an inverted-cone shape. A spindle shape, in which a coil diameter is largest at an up-down direction middle section and becomes progressively smaller towards the top and bottom of the return spring, may be used. Another possibility is a drum shape in which the coil diameter is smallest at an up-down direction middle section and becomes progressively larger towards the top and bottom of the return spring.

(4) The return spring is not limited to having an inverted-cone shape in which the coil diameter progressively reduces from a top section to a bottom section. A return spring in which the coil diameter progressively increases from a top section to a bottom section may be used.

What is claimed is:

1. A lash adjuster comprising:

a cylinder having a base;

a plunger that is movable up and down in contact with an internal peripheral surface of the cylinder, the plunger having a base wall, and a valve hole being provided in the base wall of the plunger;

a low-pressure chamber provided in the plunger;

a high-pressure chamber provided in a lower end part of the cylinder;

a return spring provided in the high-pressure chamber, the return spring biasing the plunger in an upwards direction and having a coil diameter, a top section, and a bottom section; and a non-return valve that opens and closes the valve hole, the non-return valve being a valve member disposed in the high-pressure chamber, wherein the low-pressure chamber holds operating oil and the high-pressure chamber is filled with the operating oil, and the high-pressure chamber and the low-pressure chamber are separated by the base wall of the plunger, wherein the return spring is a compression coil spring arranged in the high-pressure chamber such that a longitudinal axis of the return spring is parallel with an up-down direction, wherein the coil diameter of the return spring is largest at an uppermost end of the return spring and becomes progressively smaller from the top section to the bottom section, wherein the valve member is a single body that includes a retainer part and an elastic bending piece, the retainer part being fixed to the base wall of the plunger and the elastic bending piece being operable to open and close the valve hole by bending in the up-down direction, wherein the return spring includes a flat strip which is elongated in a direction perpendicular to the longitudinal axis of the return spring when the return spring is in a compressed state and when the return spring is not fully compressed, and wherein an upper surface of the flat strip of the return spring is an elongated contact face which faces in a direction parallel to the longitudinal axis of the return spring, and the contact face of the flat strip makes face-to-face contact with the retainer part.

2. The lash adjuster according to claim 1, wherein the uppermost end of the return spring is an end closest to the base wall of the plunger, and wherein the plunger is movable in the up-down direction.

3. The lash adjuster according to claim 1, wherein the retainer part and the elastic bending piece are formed in substantially a same plane, and are substantial plate-like.

4. The lash adjuster according to claim 1, wherein a seal part with a curved surface is formed on the elastic bending piece, and the seal part contacts an edge of the valve hole in the base wall of the plunger to close the valve hole.

5. The lash adjuster according to claim 1, wherein a recessed portion is provided in a lower surface of the base wall of the plunger, and the retainer part is forcibly inserted into the recessed portion.

6. The lash adjuster according to claim 3, wherein a recessed portion is provided in a lower surface of the base wall of the plunger, and the retainer part is forcibly inserted into the recessed portion.

7. The lash adjuster according to claim 4, wherein a recessed portion is provided in a lower surface of the base wall of the plunger, and the retainer part is forcibly inserted into the recessed portion.

8. The lash adjuster according to claim 1, wherein the return spring is capable of compressing to a compressed state in which an overall height of the return spring is less than a spring wire thickness of the return spring multiplied by a number of coils of the return spring.

9. The last adjuster according to claim 1, wherein the low-pressure chamber is in fluid communication with the high-pressure chamber through the valve hole, and wherein the elastic bending piece contacts an edge of valve hole in the base wall of the plunger to close the valve hole.

10. The lash adjuster according to claim 1, wherein the top section of the return spring contacts the retainer part of the valve member.

11. The lash adjuster according to claim 1, wherein the retainer part of the non-return valve is ring-shaped and has a first portion and a second portion, wherein the elastic bending piece of the non-return valve has a leading end part and a base end part, the base end part being connected to the first portion of the retainer part, and the elastic bending piece elastically deforms about the base end part as a fulcrum such that the leading end part moves to open and close the valve hole, and wherein the contact face of the flat strip makes face-to-face contact with the second portion of the retainer part.

12. The lash adjuster according to claim 1, wherein the retainer part is formed as a continuous ring.

13. A lash adjuster comprising:

a cylinder having a base;

a plunger that is movable up and down in contact with an internal peripheral surface of the cylinder, the plunger having a base wall, and a valve hole being provided in the base wall of the plunger;

a low-pressure chamber provided in the plunger;

a high-pressure chamber provided in a lower end part of the cylinder;

a return spring provided in the high-pressure chamber, the return spring biasing the plunger in an upwards direction and having a coil diameter, a top section, and a bottom section; and a non-return valve that opens and closes the valve hole, the non-return valve being a valve member disposed in the high-pressure chamber, wherein each of the low-pressure chamber and the high-pressure chamber is configured to hold operating oil, and the high-pressure chamber and the low-pressure chamber are separated by the base wall of the plunger, wherein the return spring is a compression coil spring arranged in the high-pressure chamber such that a longitudinal axis of the return spring is parallel with a longitudinal axis of the plunger, wherein the coil diameter of the return spring is largest at an uppermost end of the return spring and becomes progressively smaller from the top section to the bottom section, wherein the valve member is a single body that includes a retainer part and an elastic bending piece, the retainer part being fixed to the base wall of the plunger and the elastic bending piece being operable to open and close the valve hole by bending in an up-down direction, wherein the return spring includes a flat strip which is elongated in a direction perpendicular to the longitudinal axis of the return spring when the return spring is in a compressed state and when the return spring is not fully compressed, and wherein an upper surface of the flat strip of the return spring is an elongated contact face which faces in a direction parallel to the longitudinal axis of the return spring, and the contact face of the flat strip makes face-to-face contact with the retainer part.

14. The lash adjuster according to claim 13, wherein the uppermost end of the return spring is an end closest to the base wall of the plunger, and wherein the plunger is movable in the up-down direction.

15. The lash adjuster according to claim 11, wherein a recessed portion is provided in a lower surface of the base wall of the plunger, and the retainer part is forcibly inserted into the recessed portion.

16. The lash adjuster according to claim 11, wherein the return spring is capable of compressing to a compressed state in which an overall height of the return spring is less than a spring wire thickness of the return spring multiplied by a number of coils of the return spring.

17. The last adjuster according to claim 11, wherein the low-pressure chamber is in fluid communication with the high-pressure chamber through the valve hole, and wherein the elastic bending piece contacts an edge of valve hole in the base wall of the plunger to close the valve hole.

18. The lash adjuster according to claim 11, wherein the top section of the return spring contacts the retainer part of the valve member.

19. The last adjuster according to claim 13, wherein the low-pressure chamber is in fluid communication with the high-pressure chamber through the valve hole, and wherein the elastic bending piece contacts an edge of valve hole in the base wall of the plunger to close the valve hole.

20. The lash adjuster according to claim 13, wherein the top section of the return spring contacts the retainer part of the valve member.

* * * * *